US005301379A

United States Patent [19]

Schaal

[11] Patent Number: 5,301,379

[45] Date of Patent: Apr. 12, 1994

[54] DRY-CLEANING METHOD USING IGNITABLE OR POTENTIALLY EXPLOSIVE SOLVENTS

[75] Inventor: Ulrich Schaal, Konstanz, Fed. Rep. of Germany

[73] Assignee: Rewatec AG, Zuckenried, Switzerland

[21] Appl. No.: 917,830

[22] Filed: Jul. 21, 1992

[30] Foreign Application Priority Data

Aug. 8, 1991 [CH] Switzerland ..... 02346/91

[51] Int. Cl.[5] ..... D06F 43/02; D06F 43/08

[52] U.S. Cl. ..... 8/158; 68/18 C

[58] Field of Search ..... 8/158; 68/18 R, 18 C

[56] References Cited

U.S. PATENT DOCUMENTS

| | | | |
|---|---|---|---|
| 1,291,266 | 1/1919 | Traube | 68/18 R X |
| 2,639,599 | 5/1953 | Wellford, Jr. | 68/18 C |
| 3,426,555 | 2/1969 | McCutcheon, Jr. | 68/18 C X |
| 3,738,127 | 6/1973 | Hyams | 68/18 C |
| 3,771,334 | 11/1973 | Quackenbush | 68/18 C |
| 3,800,566 | 4/1974 | Zucchini | 68/18 C X |

FOREIGN PATENT DOCUMENTS 321542 1/1903 France .

*Primary Examiner*—Philip R. Coe

*Attorney, Agent, or Firm*—Frishauf, Holtz, Goodman & Woodward

[57] ABSTRACT

To permit the use of combustible and potentially explosive solvents used in dry-cleaning operations, based on hydrocarbon compounds, the dry-cleaning machine is formed with an explosion-resistant housing (8) surrounding a perforated, rotatable drum (1) into which the goods are introduced. After carrying out the normal dry-cleaning procedure, and draining of dry-cleaning solvent, a vacuum pump generates an under-pressure, in the order of below 500 mbar, and preferably about 230 mbar, while heating the mixture, to effect drying. A cooling coil, located at a lower portion of the machine, provides for condensation of solvent out of the solvent-air mixture, and, after the major portion of the solvent has been evaporated, the heat exchanger is switched over to cooling for final condensation of any remanent solvent. The vacuum continues to be maintained, so that the boiling point of solvent, due to the under-pressure, is lowered by at least 40° C., and preferably 50° C. or more, below the boiling point at ambient air pressure, so that explosions are reliably prevented, and, if they should occur nevertheless, the explosive force is substantially decreased since the starting pressure of the explosive force is already substantially below atmospheric pressure.

11 Claims, 3 Drawing Sheets

DRY-CLEANING METHOD USING IGNITABLE OR POTENTIALLY EXPLOSIVE SOLVENTS

FIELD OF THE INVENTION

The present invention relates to a method and an apparatus for cleaning and drying goods, particularly textiles, in a solvent, and especially to such a method and apparatus which permits use of a combustible or ignitable solvent, possibly subject to spontaneous combustion or to explosion.

BACKGROUND

Chemical cleaning installations for textiles, hereinafter for short "dry-cleaning apparatus", as well as dry-cleaning methods, usually use solvents and cleaning substances such as chlorinated hydrocarbons; perchlorethylene (PCE) is a common cleaning agent. Such dry-cleaning agents are suitable, they are non-combustible, and not explosive. They do, however, have a substantial disadvantage in that these solvents, when evaporating, detrimentally affect the ozone layer surrounding the earth. Additionally, they are somewhat toxic and long-term handling is dangerous to the health of the operators. Efforts have been made to replace the well known chlorinated hydrocarbon cleaning agents with solvents or cleaning agents which are environmentally acceptable and benign, non-toxic, and not detrimental to operators handling freshly dry-cleaned goods, typically garments, or other textile materials. The dry-cleaning agents must, additionally, meet environmental protection laws and regulations, as well as health laws and regulations instituted by governmental authorities.

Difficulties have been encountered in converting apparatus used in dry-cleaning with hydrocarbons to be useful with non-toxic agents since dry-cleaning agents which meet the requirements of environmental and health acceptability known in the industry are, unfortunately, combustible and, under some conditions, the gases emitted therefrom are potentially explosive. Consequently, conventional dry-cleaning machinery and methods cannot be used with dry-cleaning agents of this type.

THE INVENTION

It is an object to provide a dry-cleaning method for cleaning and then drying goods, typically textile goods, and which permits use of dry-cleaning agents, such as liquids or solvents, which are combustible and potentially subject to explosion.

Briefly, the goods are loaded into a machine which, merely for treatment, can be conventional, for example by introducing the goods into a drum which has perforated circumferential walls, located within a housing which can be filled, at least partially, with the dry-cleaning agent. To permit use of a dry-cleaning agent which is combustible and potentially explosive, the solvent or dry-cleaning agent is filled into the machine at ambient temperature, and the machine then started by revolving the drum. After cleaning the drum is spun at high speed, with the machine closed. The liquid solvent is drained through suitable conduits and valves.

The invention is based on the realization that fluids, which potentially may cause explosions when in liquid form, do not explode; they explode only when an explosive mixture of air and gases from the liquid is present. The combustion temperature and conditions of this mixture, when it is explosive, depend on the particular substances. To prevent the formation of potentially explosive gases, the cleaning fluid is centrifugally extracted and drained while in liquid form, at ambient temperature, which is well below the flame or explosion temperature.

In order to prevent the occurrence of potentially explosive vapors, and in accordance with a feature of the invention, the machine is so constructed that it can be rendered air and gas-tight. Additionally, as an extra safety precaution, the machine, preferably, is made strong enough to be explosion-resistant. After spinning, and draining the liquid agent expelled thereby, the machine is evacuated so that an air solvent mixture, due to air entrapped in the goods and remaining in the machine, is subjected to under-pressure or a vacuum. The air-solvent mixture is heated while maintaining under-pressure, so that the remaining solvent or dry-cleaning agent still in the goods will vaporize. The under-pressure and heating is so controlled that the content of solvent within the air-solvent mixture is too rich to cause an explosion. The remaining solvent, thus, can be condensed and removed and then the still remaining air-solvent mixture can be cooled and the solvent condensed off. This, in effect, dries the goods and, when the drying process is finished, the machine can be opened, so that the interior thereof will return to normal and ambient air pressure and the now cleaned goods can be removed from the machine.

In accordance with a feature of the invention, the under-pressure or partial vacuum so lowers the boiling point of the solvent that the overall operating energy required is low. Generating under-pressure or vacuum further increases the drying speed by permitting drying at an elevated temperature. The recovery rate of the solvent from the air-solvement mixture is high, without the mixture ever reaching a ratio which permits the mixture to become explosive.

In accordance with a feature of the invention, the housing is constructed with a barrel-shaped or bulged door, defining, internally, a cavity, in which heat exchange elements providing for heating and cooling of the air-solvent mixture are installed. Additionally, the bulging or internally concave construction of the door permits installation of a ventilator or fan for circulation of the air-cleaning agent mixture between the perforated drum and the heat exchange elements, typically coils, through which heated water or a water-steam mixture and cooling water respectively is passed. The arrangement is so made that the drum rotates within the housing leaving duct spaces for communication of the air-cleaning agent mixture with the respective heat exchange elements and recirculation of the mixture by the fan or ventilator which, preferably, is axially arranged in the door.

DRAWINGS

DETAILED DESCRIPTION

Figure 1:
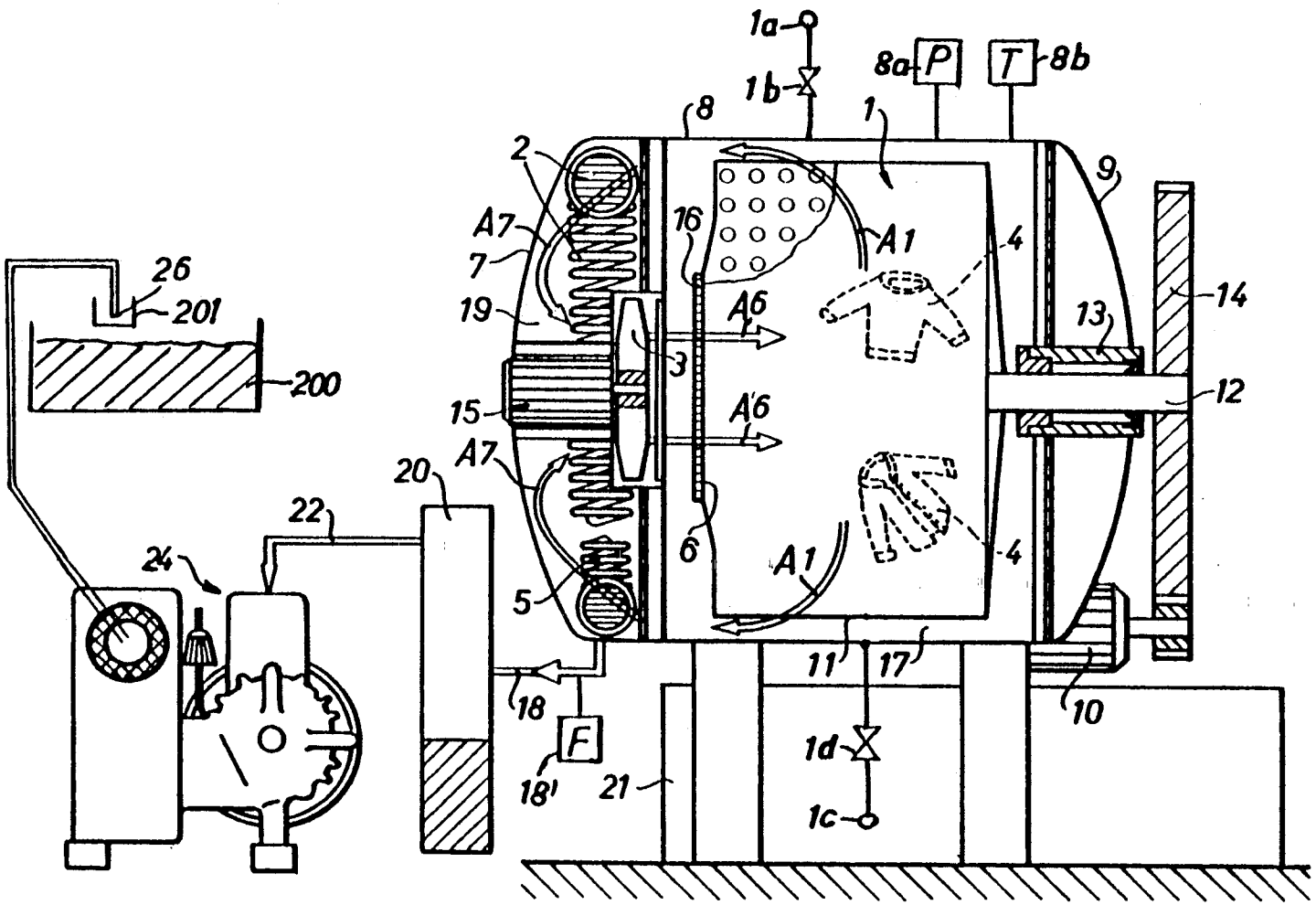
FIG. 1 illustrates a highly schematic vertical cross-sectional view through a dry-cleaning machine carrying out the method, omitting all elements well known in this industry, and showing construction features only schematically.

Referring first to FIG. 1:

Goods to be dry-cleaned, for example textile goods 4, which may be woven or knit fabric, leather, furs, or metallic goods, such as workpieces which are to be degreased, or, in general, any goods subjected to a cleaning agent, are introduced through a door 6 into a drum 1. The drum 1 is perforated. The drum 1 is located within a housing 8, seated on a base 21. The housing 8 has an end shell 9, which is outwardly bulged, so that the entire structure is somewhat barrel-shaped. The housing 8 can be cylindrical, and is spaced from the drum 1 by a ring space 17. A door 7, which can be pivoted away from the housing 8, is located at the side opposite the end 9. The door 7, also, is bulged outwardly and defines at the inside a cavity or inner space 19. The drum 1 is rotated by a motor 10, located preferably outside of the housing 8, and driving the drum 1 via a gear 14 seated on the shaft 12 passing through the door 9, and retaining the drum 1 in suitable bearings 13 located in the end 9.

In accordance with a feature of the invention, a ventilator or fan 3 is located coaxially with the shaft 12 at the center of the door 7. A motor 15, which can be an explosion-proof, sealed motor, drives the fan blades of the fan 3. The end of the drum at the door 6 is perforated, and forms a sieve 16 so that air can be circulated by the ventilator through the openings of the door 6. The air can be heated by a heating coil system 2 located within the cavity 19 of the door 7. Cooling coils 5 are located diametrically opposite the heating coils 2 within the space 7. Upon operation of the fan, the air-solvent mixture can circulate between the interior of the drum 1, then over and behind the heating and cooling coils 2, 5, and then through the ring space 17, as schematically illustrated by the arrows A1, A7 and A6, to form a closed gas-solvent mixture circulating loop. Solvent is introduced into the interior of the housing through a suitable inlet 1*a*, controlled by a valve 1*b*, and can be drained from the housing from a suitable outlet 1*c*, controlled by a valve 1*d*. In addition, and in accordance with a feature of the invention, solvent condensate can be passed through a condensate drain line 18 into a container or vessel 20 external of the housing. Vessel 20 is coupled through pipe line 22 to a vacuum pump 24. The vacuum pump 24 is likewise cooled, and condensate therefrom is captured in a solvent reception tank 200. Air, essentially free from solvent remnants, is emitted through an outlet opening 26.

Figure 2:
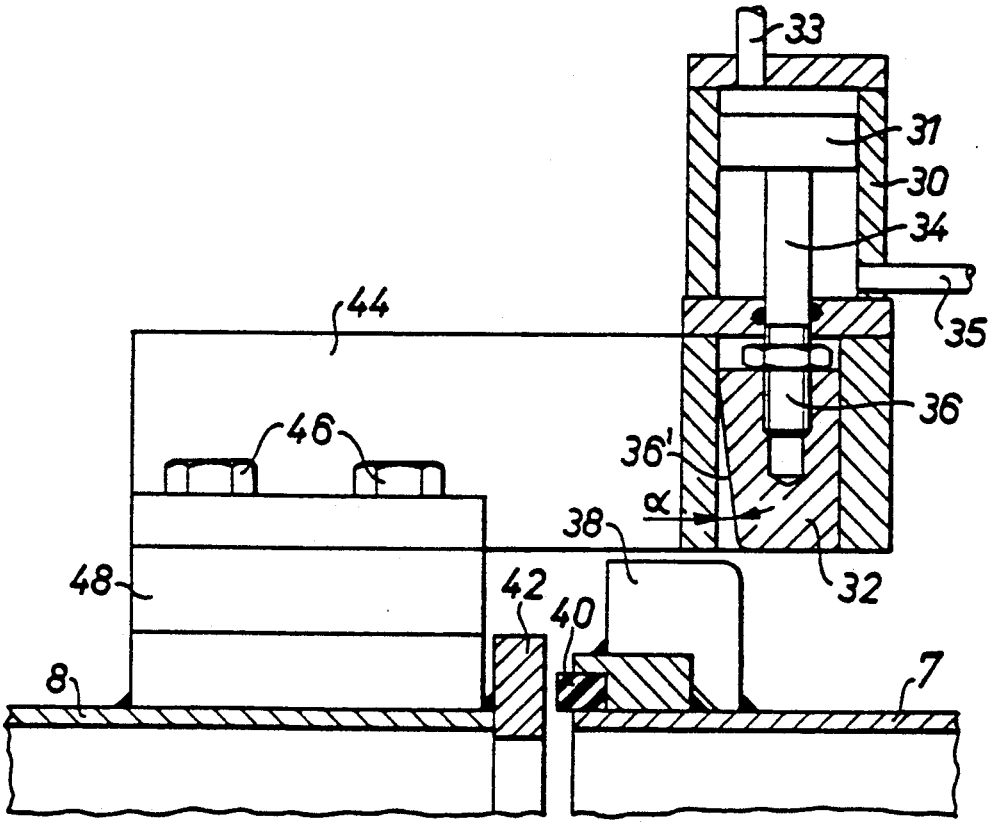
FIG. 2 is an enlarged part-sectional fragmentary view of the door, illustrating the door closing and sealing arrangement.

A tight, explosion-resistant seal is provided for the door 7. Referring now to FIG. 2: An elastic sealing ring 40 is located circumferentially around the door, and to tightly seal the door 7 against the facing end of the housing 8, a plurality of wedges 32 are located surrounding the housing 8. The wedges 32 can be moved up and down, respectively, by a double-acting cylinder 30, which is secured to the housing 8. An elongated intermediate support element 48 is secured by screws 46 to the housing 8. A double-acting piston 31 is located within the cylinder 30, coupled to the wedge 32 by a piston rod 34 and an adjustable coupling element 36. The element 36 is threaded and can be rotated by an adjustment nut, for adjustment of the wedge 32. The wedge 32 has an inclined surface 36'. The surface 36' is operatively associated with an abutment element 38 on the door 7. The wedge angle $\alpha$ is so small that, once the wedge 36 is moved downwardly by the piston 31, the pressure can be released and the wedge will not move, that is, it is self-locking. A suitable angle $\alpha$ is below 10°, for example about 7°. This self-holding feature is important since it prevents possible opening of the door upon interruption of the operating force acting on the cylinder 31. Upon evacuation of the drum, the wedges automatically move downwardly as the elastic seal 40 compresses against its matching seat 42 on the housing 8. The cylinder-piston unit 30, 31 is double-acting and to move the piston 31 in downward direction, with respect to FIG. 2, pressure medium is introduced through the inlet 33. To raise the wedge 32, pressure medium is introduced through line 35, and line 33 is connected to drainage or open connection. Control of pressure medium can be obtained in any well known and suitable manner, for example under computer control, which, additionally, provides for interlocking of functions, so that dry-cleaning cannot be started until the door is securely locked.

Figure 3:
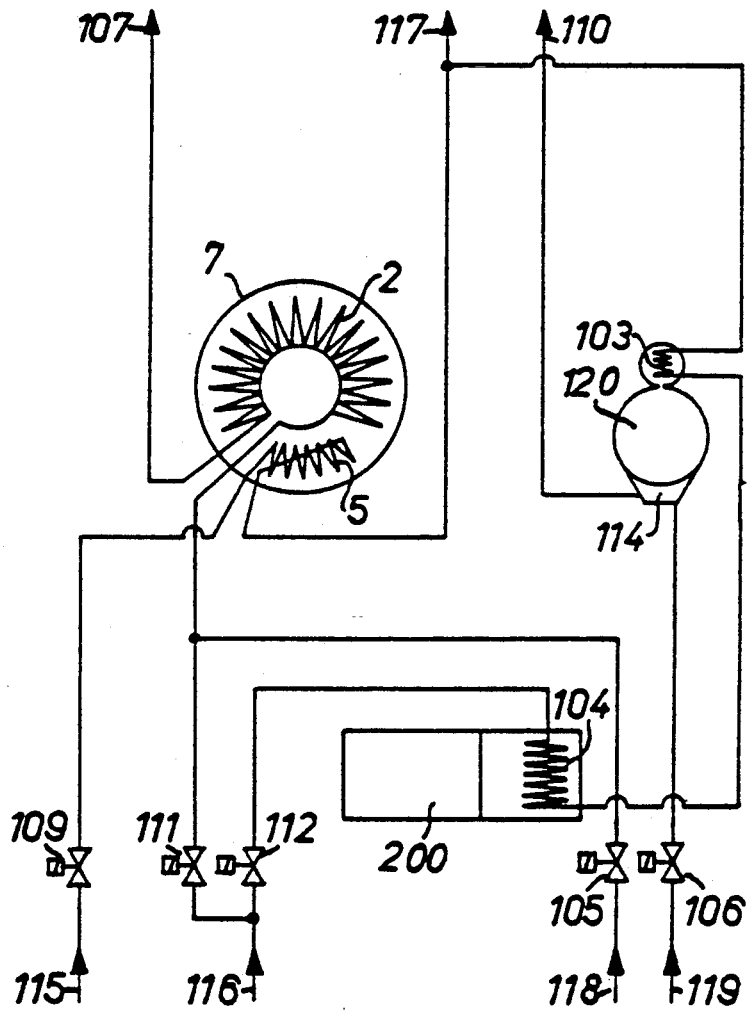
FIG. 3 is a schematic diagram illustrating the heat exchange and, partly, solvent circuit in the machine.

The heating-cooling circuit is best seen in combination with FIG. 3:

Cooling water is supplied from a cold water supply 115 through a valve 109 to the cooling coils 5. The cooling water is drained through a drain line 117. A further water supply, which can come from a central supply, is coupled to connection 116, and a valve 111 permits, selectively, supply of cooling water to the coils 2, or heated water, as will appear, with drainage through line 107. To provide for heating, a steam connection 118, controlled by a valve 105, can introduce steam into the water supply through valve 111. A further steam line 119 is connected, through a valve 106, to a steam chamber 114, which can drain through line 110. The steam in chamber 114 is used to heat solvent in a vacuum distillator 120, which can include, or form the vessel 20 (FIG. 1).

A cooling coil 104, omitted in FIG. 1 for clarity of the drawing, is located in the solvent reception tank 200 (FIGS. 1 and 3). This water is then conducted to a condenser 103, to be then connected to the cooling water drain line 117.

The entire machine, and especially the housing 1, is constructed to be explosion-resistant or explosion-proof so that, in the unlikely case of an explosion within the interior of the housing, not external damage can result, nor can explosive gases be emitted to the atmosphere.

Explosion pressure depends on the respective starting pressure, and, in dependence on the respective cleaning agent or material used, is at the most 6 to 8 times the starting pressure. Since the starting pressure within the interior of the drum 1 is lowered due to the under-pressure or partial vacuum generated by the vacuum pump 24, the explosion pressure would also be equally reduced.

Method of dry-cleaning and operation of the apparatus

Suitable, typical dry-cleaning fluids are hydrocarbon liquids, preferably an isoparaffin. Suitable mixtures are aliphatic nphtene hydrocarbons, in the range of C11–C12, or isoparaffin hydrocarbons. Commercial materials are known under the trade name Shellsol T, made by Shell, Or Isopar H, made by Exxon.

The door 7 is opened, the door 6 to the drum 1 is opened, and the goods 4 are introduced into the drum 1. The door 6 of the drum 1 is then closed, and then the door 7 is closed. After closing of the door 7, a seal tightness test of the door closure is carried out, for example by a compressed air or vacuum test. The tightness of the door 7 having been checked, solvent can be introduced through inlet 1*a*, upon opening valve 1*b*, the motor 10 is started and the drum 1 rotated. Cleaning can now be carried out under ambient normal pressure and ambient temperature. This ambient temperature is substantially below the flame point of the solvent. After the customary cleaning time has elapsed, drum is rotated at high speed, and cleaning agent can be drained through valve 1*d* to the cleaning valve outlet 1*c*, coupled, for example, to a filter, for recuperation and recycling. Additionally, liquid solvent can be emitted through line 18 and collected in the vessel 20. The drum 1 is spun at high speed for spin-drying of the goods 4 therein.

Evacuation of the drum 1 is begun towards the termination of the spinning cycle, in order to reduce the upper explosion limit by temperatures below the flame point, that is, in order to reduce the starting pressure in case of a hypothetical explosion, by a multiple of that which might happen under atmospheric conditions. Of course, at that time, valve 1*d* is closed. Upon evacuation, the heating coil 2 is energized by opening steam valve 118 and water supply valve 111. When the under-pressure or vacuum has reached a value of below about 500 mbar, and preferably of about 230 mbar, ventilator 3 is started by energizing motor 15. Drying will now occur in the evacuated drum 1, in which the remaining air-solvent mixture is circulated while it is being heated. Ventilator 3 blows the mixture into the interior of the perforated drum 1 and, after passage through the duct space 17, the air will come behind the heat exchange unit 2, 5 to form a closed cycle, being returned again into the drum 1 by the ventilator 3.

Based on experience, and when a substantial portion of the solvent has been thus evaporated, the cooling coils 5 receive cooling water in order to enhance condensation of remanent solvent in the solvent-air mixture. The flow of condensate through line 18 close to the cooling coil 7 is monitored and when practically all cleaning agent or solvent has been vaporized out of the goods 14, heat supply is interrupted to the coils 2 and, rather, cooling water is supplied to the coils 2, so that the coils 2 then will function as a cooling heat exchanger. This results in rapid condensation of any remnants of the cleaning agent still in the air. Remnant cleaning agents and any air therein from the vessel 20 are drawn into the cooled vacuum pump 24, in which final remaining condensation of solvent from the solvent-air mixture takes place. The air, now practically free of any solvent or cleaning agent, leaves the vacuum pump 24 through the outlet 26. Any possibly still present drops of solvent can be separated by a demister 201.

Drying can be carried out in the drum about the flame point of the cleaning agent since the drum has been evacuated, without any danger of explosion or spontaneous ignition. The under-pressure drops the boiling point of the solvent by about 50° C.

As well known, combustible liquids are explosive only in certain air-liquid vapor ranges. Above and below these ranges—in dependence of the particular agent used—no explosion can occur. Dropping pressure in the drum drops the boiling point of the solvent by at least 50° C. Within the interior of the drum, the concentration of solvent is high, and the concentration is substantially higher than at normal pressure, so that the explosion limit at which an explosion could occur is exceeded. Additionally, the under-pressure has the effect that, in the hypothetical case of an explosion, the explosion pressure will be substantially lower than at ambient pressure. Such lower pressure can readily be accepted by dry-cleaning apparatus based on its construction.

The under-pressure additionally improves the drying process by improving vaporization of the cleaning agent out of the goods to be treated, since, by the lowering of the pressure and the consequent lowering of the boiling point, the saturation limit is substantially increased. As a consequence, the solvent can be removed from the treatment goods 4 to a substantially better degree than heretofore, and, particularly, at comparable temperatures at normal pressures. During pressure decrease, the heated air solvent mixture is much too rich to permit an explosion to occur.

The system is provided with sensors which monitor temperature and pressure, as well as condensate flow. The temperature and pressure sensing thus indirectly sense the composition of the air-cleaning agent mixture and provide output indications to indirectly check the presence of potentially dangerous concentrations of mixtures within the housing 8. FIG. 1 schematically illustrates a flow sensor 18' coupled to line 18 to check condensate flow, and pressure sensor 8*a* as well as temperature sensor 8*b* coupled to the housing 8 to sense temperature and pressure therein.

Interlocks as well as supervisory control, standard components, elements and connections have been shown only schematically or, to the extent that they are well known in the field of the present invention, have been omitted entirely.

I claim:

1. A dry-cleaning method for cleaning and drying goods, by use of a liquid solvent, said method being suitable for use wherein the liquid solvent is combustible or, where its vapors, when mixed with air, are potentially explosive, comprising the steps of loading a closable dry-cleaning machine with the goods;

closing and air-tightly sealing the dry-cleaning machine;

supplying and adding the liquid solvent under ambient temperature and pressure conditions into the machine to form, within the machine, a mixture of liquid solvent and air;

carrying out dry-cleaning of the goods by moving the goods about while in the liquid solvent;

draining the liquid solvent from the machine;

evacuating the interior of the machine while the machine is closed, resulting in under-pressure;

then, while maintaining the under-pressure in the machine, heating the mixture of solvent and air in the machine to a temperature above the boiling point of the solvent, whereby the solvent in the goods will vaporize, said heating and evacuating step being carried out to an extent which maintains enough solvent in the vessel to form an air-solvent mixture which is excessively rich, thus inhibiting spontaneous combustion or explosion;

then, and while continuing to maintain the machine subject to the under-pressure or vacuum condition, cooling said air-solvent mixture in the machine to drop the temperature to a temperature level below the flame point, whereby the goods will be dried;

condensing the air-solvent mixture to separate solvent from the mixture;

reestablishing ambient atmospheric pressure in the machine in advance of opening the machine; and then opening the machine and removing the goods therefrom.

2. The method of claim 1, wherein said solvent comprises non-halogenated hydrocarbons, and optionally mixtures of nphtenic and aliphatic hydrocarbons or isoparaffinic hydrocarbons.

3. The method of claim 1, wherein the step of evacuating the interior of the machine comprises dropping the pressure in the machine to a level of at most about 500 mbar, and optionally to about 230 mbar; and wherein the step of condensation of solvent from the solvent-air mixture during the cooling step is carried out at least in part outside of the machine.

4. The method of claim 1, further including the step of testing the sealed tightness of the machine before subjecting the machine to the evacuation step.

5. The method of claim 1, wherein the step of evacuating the interior of the machine comprises evacuating the interior to a level such that the boiling point of the solvent in the machine is lowered by at least 40° C., and optionally by about 50° C., below the boiling point of the solvent at ambient pressure.

6. The method of claim 1, wherein the cooling and condensing step includes providing a cooling and condensing region (5) within the machine while the mixture of solvent and air is heated and being circulated through the machine, and drawing off condensed solvent from said condensing region.

7. The method of claim 1, wherein said steps of heating the mixture of solvent and air and subsequently cooling and condensing the solvent-air mixture are carried out by circulating, first, a hot fluid through a heat exchanger (2) and circulating the solvent-air mixture by a forced air circulator (3) over a heat exchanger; and then passing a cold fluid through the heat exchanger while continuing to circulate the air-solvent mixture thereover; and further including the step of draining condensate from the machine, said steps recited in this claim being carried out while the machine is subjected to under-pressure.

8. The method of claim 7, wherein said machine has a single heat exchanger for heating the mixture of solvent and air and subsequently cooling and condensing the solvent-air mixture, and wherein said steps of heating the mixture of solvent and air and subsequently cooling and condensing the solvent-air mixture comprises subjecting said mixture of solvent and air to the heat exchanger, and first passing a hot fluid through the single heat exchanger and then passing a cold fluid through the single heat exchanger.

9. The method of claim 1, wherein said goods comprise textile goods.

10. The method of claim 9, including, in combination with the step of draining the liquid solvent from the machine, the step of spinning the goods in the machine to remove liquid solvent from the goods by centrifugal force for draining of liquid from the machine, optionally rotating a drum retaining the goods at high speed to expel liquid solvent from the goods by centrifugal force.

11. The method of claim 1, further including the step of testing the sealing of the machine for airtightness before the liquid solvent is added and supplied into the machine.

* * * * *